US006534469B1

(12) United States Patent
Durbut et al.

(10) Patent No.: US 6,534,469 B1
(45) Date of Patent: Mar. 18, 2003

(54) LIQUID CLEANING COMPOSITIONS

(75) Inventors: Patrick Durbut, Verviers (BE); Guy Broze, Grace-Hollogne (BE); Françoise Mathieu, Horion-Hozemont (BE)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/236,229

(22) Filed: Sep. 6, 2002

(51) Int. Cl.[7] ..... C11D 17/00

(52) U.S. Cl. ..... 510/417; 510/426; 510/422; 510/432; 510/492; 510/506; 510/508; 510/512; 510/480

(58) Field of Search ..... 510/417, 426, 510/427, 432, 492, 506, 508, 512, 480

(56) References Cited

U.S. PATENT DOCUMENTS

| | | | | | |
|---|---|---|---|---|---|
| 5,770,554 | A | * | 6/1998 | Misselyn et al. | 510/426 |
| 5,994,283 | A | * | 11/1999 | Durbut et al. | 510/242 |
| 6,197,732 | B1 | * | 3/2001 | Davister et al. | 510/122 |
| 6,197,741 | B1 | * | 3/2001 | Davister et al. | 510/417 |
| 6,303,555 | B1 | * | 10/2001 | Davister et al. | 510/320 |
| 6,306,809 | B1 | * | 10/2001 | Davister et al. | 510/237 |
| 6,391,843 | B1 | * | 5/2002 | Davister et al. | 510/426 |
| 6,420,325 | B2 | * | 7/2002 | Davister et al. | 510/125 |

* cited by examiner

*Primary Examiner*—Necholus Ogden
(74) *Attorney, Agent, or Firm*—Richard E. Nanfeldt

(57) ABSTRACT

All purpose cleaning or microemulsion compositions more environmentally friendly, which is especially effective in the removal of oily or greasy soils, contains a positively charged surfactant-polymer complex, a hydrocarbon ingredient, a cosurfactant, and water.

1 Claim, No Drawings

LIQUID CLEANING COMPOSITIONS

FIELD OF THE INVENTION

The present invention relates to a hard surface cleaning composition containing a positively charged surfactant-polymer complex.

BACKGROUND OF THE INVENTION

This invention relates to an improved all-purpose liquid cleaner designed in particular for cleaning hard surfaces and which is effective in removing grease soil and/or bath soil and in leaving unrinsed surfaces with a shiny appearance.

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of 25 to 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to 18% by weight of the aqueous phase), the presence of such high quantities of grease-removal solvent tend to reduce the total amount of greasy or oily soils which can be taken up by and into the microemulsion without causing phase separation.

The following representative prior art patents also relate to liquid detergent cleaning compositions in the form of o/w microemulsions: U.S. Pat. Nos. 4,472,291—Rosario; 4,540,448—Gauteer et al; 3,723,330—Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; 4,414,128; and 4,540,505. For example, U.S. Pat. No. 4,414,128 broadly discloses an aqueous liquid detergent composition characterized by, by weight:

(a) from 1% to 20% of a synthetic anionic, nonionic, amphoteric or zwitterionic surfactant or mixture thereof;

(b) from 0.5% to 10% of a mono- or sesquiterpene or mixture thereof, at a weight ratio of (a):(b) being in the range of 5:1 to 1:3; and (c) from 0.5% 10% of a polar solvent having a solubility in water at 15° C. in the range of from 0.2% to 10%. Other ingredients present in the formulations disclosed in this patent include from 0.05% to 2% by weight of an alkali metal, ammonium or alkanolammonium soap of a $C_{13}$–$C_{24}$ fatty acid; a calcium sequestrant from 0.5% to 13% by weight; non-aqueous solvent, e.g., alcohols and glycol ethers, up to 10% by weight; and hydrotropes, e.g., urea, ethanolamines, salts of lower alkylaryl sulfonates, up to 10% by weight. All of the formulations shown in the Examples of this patent include relatively large amounts of detergent builder salts which are detrimental to surface shine.

A pH neutral microemulsion composition based on paraffin sulfonate and ethoxylated nonionic surfactant is able to deliver improved grease cleaning versus built, alkaline compositions. Besides the improved grease cleaning, this approach is much safer to surfaces as well as less aggressive on consumer's hands (Loth et al—U.S. Pat. No. 5,075,026).

The microemulsion technology provides outstanding oil uptake capacity because of the adjustment of the curvature of the surfactant micelles by the molecules of the cosurfactant. Rod-like micelles are preferred as they can "swallow" oil to become globular without increasing the surface of contact between the hydrophobic core of the micelle and the hydrophilic continuous phase.

In diluted usage however, the microemulsion state is usually lost and the cleaning performance relies on the adsorption efficacy and leaving character of the surfactant system. Nonionic surfactants perform very well on grease, as they are excellent grease "solubilizers". Actually, they spontaneously form swollen micelles. In moderate climate countries such as the northern states of the United States and the northern countries of Europe, the soil on the hard surfaces contains a major proportion of greasy materials. It is accordingly not surprising that the anionic-nonionic surfactant based microemulsion is so very efficient in those countries. However, nonionic surfactants do not impart oil repelling properties and can not deliver soil antiattachment properties on treated hard surfaces so as to achieve next time easier cleaning of said treated surface.

The instant invention teaches hard surface cleaning containing a positively charged complex of an anionic surfactant which is an alkali metal salt such as sodium of a fluoroalkyl sulfonate, or an ammonium salt of a fluoroalkyl sulfonate, or a mixture thereof, which exhibits very low surface tensions with a polycationic polymer that imparts oil repelling properties and delivers soil antiattachment properties on treated hard surfaces and delivers this desired property.

SUMMARY OF THE INVENTION

The present invention provides an improved, clear, liquid hard surface cleaning composition having improved interfacial tension which improves cleaning hard surfaces such as plastic, vitreous and metal surfaces having a shiny finish, oil stained floors, automotive engines and other engines. More particularly, the improved cleaning compositions exhibit good grease soil removal properties and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products. The instant compositions exhibit a grease release effect in that the instant compositions impede or decrease the anchoring of greasy soil on surfaces that have been cleaned with the instant compositions as compared to surfaces cleaned with a microemulsion composition which means that the grease soiled surface is easier to clean upon subsequent cleanings.

Surprisingly, these desirable results are accomplished even in the absence of polyphosphate or other inorganic or organic detergent builder salts and also in the complete absence or substantially complete absence of grease-removal solvent.

The invention generally provides a stable, clear all-purpose, hard surface cleaning composition especially effective in the removal of oily and greasy oil. The cleaning composition includes, on a weight basis:

about 0.1% to about 20%, more preferably about 0.2% to about 15% of a positively charged complex comprising at least one alkali metal salt of a fluoroalkyl sulfonate surfactant or at least one ammonium salt of a fluoroalkyl sulfonate surfactant or mixtures thereof, and a polycationic polymer;

about 0 to about 25%, more preferably 1% to 20%, of a water-mixable cosurfactant having either limited ability or substantially no ability to dissolve oily or greasy soil;

0 to about 1.5% of a fatty acid;

0 to about 5% of magnesium sulfate heptahydrate;

about 0 to about 5.0% of a perfume or water insoluble hydrocarbon; and the balance being water, said proportions being based upon the total weight of the composition.

The cleaning composition can be in the form of a microemulsion in which case the concentration of the water mixable cosurfactant is about 0 to about 25 wt. %, preferably about 1 wt. % to about 20 wt. % and the concentration of the perfume or water insoluble hydrocarbon is about 0.4 wt. % to about 5.0 wt. %. The dispersed oil phase of the o/w microemulsion is composed essentially of a water-immiscible or hardly water-soluble perfume.

The present invention relates to a stable all purpose hard surface cleaning or microemulsion composition containing a surfactant-polymer complex for delivering soil antiattachment properties. The invention also relates to a light duty liquid composition or light duty liquid microemulsion composition. This present invention also useful in the formation of toilet bowl cleaners.

DETAILED DESCRIPTION OF THE INVENTION

The present invention relates to a stable hard surface cleaning composition containing approximately by weight: 0.1% to 20% of a positively charged complex of an alkali metal salt of a fluoroalkyl sulfonate surfactant, or an ammonium salt of a fluoroalkyl sulfonate surfactant, or a mixture thereof, and a polycationic polymer, 0 to 25% of a cosurfactant, 0 to 5% of a water insoluble hydrocarbon or a perfume and the balance being water, wherein the cleaning composition can be in the form of a microemulsion in which case the concentration of the water mixable cosurfactant is about 0 to about 25.0 wt. %, preferably about 0.1 wt. % to about 25.0 wt. % and the concentration of the perfume or water insoluble hydrocarbon is about 0.4 wt. % to about 5.0 wt. %.

When mixing an alkali metal salt such as sodium of a fluorinated anionic surfactant, or an ammonium salt of a fluoroalkyl sulfonate surfactant, or a mixture thereof, and a polycationic polymer, attractive interactions are developed that are very strong and lead to the formation of anionic-cationic complexes in-situ. The complex interactions take place along the polymer backbone, so that surfactant-polymer complexes exist in solution. Attention must be paid not to complex all the positive charges on the polycationic polymer so as to still have enough electric charges on the whole structure so that the complex is positively charged so as to keep the complex water soluble (otherwise phase separation or precipitation might occur). The presence of positive charges on the surfactant-polymer system allows subsequent anchorage on substrate surface for modifying the surface energy.

One of the objects of the instant invention is to deliver higher proportions of an alkali metal salt of a fluoroalkyl anionic surfactant in the adsorbed layer at the solid-water interface by means of surfactant-polymer mixtures. This is due to a boosted adsorption tendency as compare to fluoroalkyl anionic individual surfactant by means of neutralization between the negative charge of the anionic surfactant and the positive charge of the polycationic polymer that is used in admixture with the anionic surfactant in the instant compositions, and due to an increased hydrophobic character imparted to the polymer by the anionic surfactant linked to its backbone. Two anionic surfactants can be used in composition wherein one of the anionic surfactants will possibly preferentially associate with the polycationic polymer through electrostatic interactions.

According to the present invention, the role of the hydrocarbon is provided by a non-water-soluble perfume. Typically, in aqueous based compositions the presence of a solubilizers, such as alkali metal lower alkyl aryl sulfonate hydrotrope, triethanolamine, urea, etc., is required for perfume dissolution, especially at perfume levels of 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

First, the cosmetic properties of the ultimate cleaning composition are improved: the compositions are both clear (as a consequence of the formation of a microemulsion) and highly fragranced (as a consequence of the perfume level).

Second, the need for use of solubilizers, which do not contribute to cleaning performance, is eliminated.

Third, an improved grease release effect and an improved grease removal capacity in neat (undiluted) usage of the composition or after dilution of the composition can be obtained without detergent builders or buffers or conventional grease removal solvents at neutral or acidic pH and at low levels of active ingredients while improved cleaning performance can also be achieved in diluted usage.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight. The essential oils themselves are volatile odoriferous compounds and also serve to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The hydrocarbon such as a perfume is present in the hard surface cleaning composition in an amount of from 0 to 5% by weight, preferably 0.4% to 5% by weight, more preferably from 0.4% to 3.0% by weight, especially preferably from 0.5% to 2.0% by weight. If the hydrocarbon (perfume) is added in amounts more than 5% by weight, the cost is increased without any additional cleaning benefit and, in fact, with some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than 20%, usually less than 30%, of such terpene solvents.

Thus, merely as a practical matter, based on economic consideration, the microemulsion compositions of the present invention may often include as much as 0.2% to 7% by weight, based on the total composition, of terpene solvents introduced thereunto via the perfume component. However, even when the amount of terpene solvent in the cleaning formulation is less than 1.5% by weight, such as up to 0.6% by weight or 0.4% by weight or less, satisfactory grease removal and oil removal capacity is provided by the inventive diluted microemulsions.

In place of the perfume one can employ a water insoluble paraffin or isoparaffin having 6 to 18 carbon at a concentration of 0 to 5 wt. percent, preferably 0.4 to 5.0 wt. percent, more preferably 0.4 to 3.0 wt. %.

The positively charged complex contained in the instant compositions comprises a complex of:

(a) an alkali metal salt such as sodium of a fluoroalkyl sulfonate anionic surfactant or an ammonium salt of a fluoroalkyl sulfonate anionic surfactant or mixtures thereof; and (b) a polycationic polymer, wherein the molar ratio of the anionic surfactant to the positively charged binding sites available on the polycationic polymer backbone is 0.95:1 to 0.05:1, more preferably 0.9:1 to 0.1:1. The instant composition contains about 0.1 to about 20 wt. %, more preferably about 0.2 to about 15 wt. % of the positively charged complex.

The fluoroalkyl sulfonate anionic surfactant which has a $R_F$ fluoroalkyl group which is a $C_{16}F_{33}$ to $C_5F_{11}$, preferably a $C_6F_{13}$ to $C_{10}F_{21}$ fluoroalkyl group and can be selected among the different compounds being depicted by the following structures of, perfluoroalkane sulfonate salt:

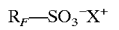

perfluoroalkylethane sulfonate salt:

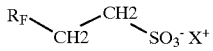

perfluoroalkyl group containing sulfonate with sulfide and carbonamide linkages:

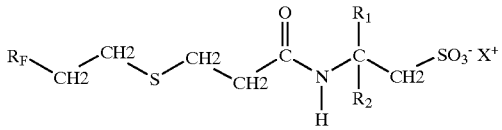

wherein, X can be an alkali metal counterion such as sodium, or an ammonium counterion such as $NH4^+$, and R1 and R2 are H or methyl groups.

The polycationic polymer is a polyacrylamide dialkyl dimethyl ammonium chloride copolymer having about 25 wt. % to 90 wt. % of the dialkyl dimethyl ammonium chloride monomer and is depicted by the structure of:

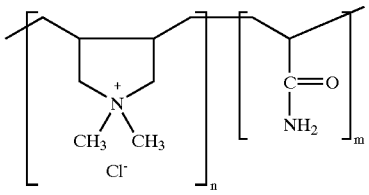

wherein m is about 5000 to about 60000.

Another useful polycationic polymer is a polyvinyl pyrrolidone/vinyl imidazole/quaternized vinyl-imidazole [40/40/20] terpolymer. The ratio of comonomers in the foregoing terpolymer is not particularly critical and can be modified to provide the desired soil antiattachment effect.

A cosurfactant can be optionally used in forming the microemulsion composition. Three major classes of compounds have been found to provide highly suitable cosurfactants over temperature ranges extending from 5° C. to 43° C. for instance; (1) water-soluble $C_3$–$C_4$ alkanols, polyethylene glycols of the formula $HO(CH_2CH_2O)nH$ wherein n is about 8 to about 14, polypropylene glycol of the formula $HO(CH_3CHCH_2O)_nH$ wherein n is a number from 2 to 18 and copolymers of ethylene oxide and propylene oxide and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl, $R_1$ is $C_2$–$C_4$ acyl group, X is $(OCH_2CH_2)$ or $(OCH_2\ (CH_3)CH)$ and n is a number from 1 to 4; (2) aliphatic mono- and di-carboxylic acids containing 2 to 10 carbon atoms, preferably 3 to 6 carbons in the molecule; and (3) triethyl phosphate. Additionally, mixtures of two or more of the three classes of cosurfactant compounds may be employed where specific pH's are desired.

When the mono- and di-carboxylic acid (Class 2) cosurfactants are employed in the instant microemulsion compositions at a concentration of 2 to 10 wt. %, the microemulsion compositions can be used as a cleaners for bathtubs and other hard surfaced items, which are acid resistant thereby removing lime scale, soap scum and greasy soil from the surfaces of such items damaging such surfaces. If these surfaces are of zirconium white enamel, they can be damaged by these compositions.

An aminoalkylene phophoric acid at a concentration of 0.01 to 0.2 wt. % can be optionally used in conjunction with the mono- and di-carboxylic acids, wherein the aminoalkylene phosphoric acid helps prevent damage to zirconium white enamel surfaces. Additionally, 0.05 to 1% of phosphoric acid can be used in the composition.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), propylene glycol monomethyl ether, dipropylene glycol monomethyl ether, triethylene glycol monobutyl ether, mono, di, tri propylene glycol monobutyl ether, tetraethylene glycol monobutyl ether, triethylene glycol monohexyl ether, tetraethylene glycol monohexyl ether, pentaethylene glycol monohexyl ether, propylene glycol tertiary butyl ether, ethylene glycol monoacetate and dipropylene glycol propionate.

Representative members of the aliphatic carboxylic acids include $C_3$–$C_6$ alkyl and alkenyl monobasic acids such as acrylic acid and propionic acid and dibasic acids such as glutaric acid and mixtures of glutaric acid with adipic acid and succinic acid, as well as mixtures of the foregoing acids.

While all of the aforementioned glycol ether compounds and acid compounds provide the described stability, the most preferred cosurfactant compounds of each type, on the basis of cost and cosmetic appearance (particularly odor), are diethylene glycol monobutyl ether or pentaethylene glycol monohexyl ether, and a mixture of adipic, glutaric and succinic acids, respectively. The ratio of acids in the foregoing. mixture is not particularly critical and can be modified to provide the desired odor. Generally, to maximize water solubility of the acid mixture glutaric acid, the most water-soluble of these three saturated aliphatic dibasic acids, will be used as the major component.

Generally, weight ratios of adipic acid: glutaric acid: succinic acid is 1-3:1-8:1-5, preferably 1-2:1-6:1-3, such as 1:1:1, 1:2:1, 2:2:1, 1:2:1.5, 1:2:2, 2:3:2, etc. can be used with equally good results.

Still other Another class of cosurfactant compounds providing stable microemulsion compositions at low and elevated temperatures are the mono-, di- and triethyl esters of phosphoric acid such as triethyl phosphate.

The amount of cosurfactant which might be required to stabilize the microemulsion compositions will, of course, depend on such factors as the surface tension characteristics of the cosurfactant, the type and amounts of the positively charged complex and perfumes, and the type and amounts of any other additional ingredients which may be present in the composition and which have an influence on the thermodynamic factors enumerated above. Generally, amounts of cosurfactant in the range of from 0 to 25 wt. %, preferably from 0.5 wt. % to 20 wt. %, especially preferably from 1 wt. % to 10 wt. %, provide stable microemulsions for the above-described levels of primary surfactants and perfume and any other additional ingredients as described below.

As will be appreciated by the practitioner, the pH of the final microemulsion will be dependent upon the identity of the cosurfactant compound, with the choice of the cosurfactant being effected by cost and cosmetic properties, particularly odor. For example, microemulsion compositions which have a pH in the range of 1 to 10 may employ either the class 1 or the class 4 cosurfactant as the sole cosurfactant, but the pH range is reduced to 1 to 8.5 when the polyvalent metal salt is present. On the other hand, the class 2 cosurfactant can only be used as the sole cosurfactant where the product pH is below 3.2. However, where the acidic cosurfactants are employed in admixture with a glycol ether cosurfactant, compositions can be formulated at a substantially neutral pH (e.g., pH 7±1.5, preferably 7±0.2).

The ability to formulate neutral and acidic products without builders which have grease removal capacities is a feature of the present invention because the prior art o/w microemulsion formulations most usually are highly alkaline or highly built or both.

The final essential ingredient in the inventive hard surface cleaning compositions having improved interfacial tension properties is water. The proportion of water in the microemulsion compositions generally is in the range of 60 wt. % to 97 wt. %, preferably 80 wt. % to 97 wt. % of the usual diluted o/w microemulsion composition.

The present invention also relates to a stable neutral or acidic microemulsion composition comprising approximately by weight:

(a) 0.1 to 20% of a positively charged complex as previously herein defined;

(b) 0 to 1.5% of a fatty acid;

(c) 1 to 25% of a cosurfactant;

(d) 0.4 to 5% of a water insoluble hydrocarbon or perfume;

(e) 0 to 10% of at least one dicarboxylic acid;

(f) 0 to 1% of phosphoric acid;

(g) 0 to 0.2% of an aminoalkylene phosphoric acid;

(h) 0 to 5% of magnesium sulfate heptahydrate; and (i) the balance being water.

The present invention also relates to a light duty liquid composition or light duty liquid microemulsion composition which comprises approximately by weight:

(a) 0.1% to 20% of the previously defined positively charged complex;

(b) 0 to 5% of a perfume, an essential oil or a water insoluble hydrocarbon;

(c) 0 to 25% of a cosurfactant; and (d) the balance being water.

In addition to the above-described essential ingredients required for the formation of the all purpose cleaning or microemulsion composition, the compositions of this invention may often and preferably do contain one or more additional ingredients which serve to improve overall product performance.

One such ingredient is a source of acidity such as hydrochloric acid or sulfuric acid for use in the formation of toilet bowl cleaners.

Another optional ingredient for use herein is an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level.

Thus, depending on such factors as the pH of the system, the nature of the surfactant-polymer complex and cosurfactant, as well as the availability and cost factors, other suitable polyvalent metal ions include aluminum, copper, nickel, iron, calcium, etc. It should be noted, for example, that with the preferred fluoroalkyl anionic detergent calcium salts will precipitate and should not be used. It has also been found that the aluminum salts work best at pH below 5 or when a low level, for example 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

The proportion of the multivalent salt generally will be selected so that at the appropriate weight ratio between the anionic surfactant and the polycationic polymer to deliver desired performance from the surfactant-polymer mixture in terms of adsorption properties on hard surfaces and soil antiattachment on treated hard surfaces, the physical stability of the total composition is kept, that can be impaired due to an increased hydrophobicity of the anionic surfactant in the presence of multivalent salt instead of alkali metal cation such as the sodium salt thereof. As a consequence, the proportion of the multivalent salt will be selected so that the added quantity will neutralize from 0.1 to 1.5 equivalents of the anionic surfactant, preferably 0.9 to 1.4 equivalents of the acid form of the anionic surfactant. At higher concentrations of anionic surfactant, the amount of multivalent salt will be in range of 0.5 to 1 equivalents per equivalent of anionic surfactant.

The hard surface cleaning compositions can optionally include from 0 to 1.5 wt. %, preferably from 0.1 wt. % to 1.0 wt. % of the composition of a $C_8$–$C_{22}$ fatty acid or fatty acid soap as a foam suppressant. The addition of fatty acid or fatty acid soap provides an improvement in the rinseability of the composition whether applied in neat or diluted form. Generally, however, it is necessary to increase the level of cosurfactant to maintain product stability when the fatty acid or soap is present. If more than 1.5 wt. % of a fatty acid is used in the instant compositions, the composition will become unstable at low temperatures as well as having an objectionable smell.

As example of the fatty acids which can be used as such or in the form of soap, mention can be made of distilled coconut oil fatty acids, "mixed vegetable" type fatty acids (e.g. high percent of saturated, mono-and/or polyunsaturated $C_{18}$ chains); oleic acid, stearic acid, palmitic acid, eiocosanoic acid, and the like, generally those fatty acids having from 8 to 22 carbon atoms being acceptable.

The all-purpose liquid cleaning or microemulsion composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-chloro-2-methyl-4-isothaliazolin-3-one, 2,6-ditertbutyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the all-purpose cleaning or clear microemulsions exhibit stability at reduced and increased temperatures. More specifically, such compositions remain clear and stable in the range of 4° C. to 50° C., especially 10° C. to 43° C. Such. compositions exhibit a pH in the acid or neutral range depending on intended end use. The liquids are readily pourable and exhibit a viscosity in the range of 6 to 60 millipascal·Second (mPas.) as measured at 25° C. with a Brookfield RVT Viscometer using a #1 spindle rotating at 20 RPM. Preferably, the viscosity is maintained in the range of 10 to 40 mPas.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type sprayer for the so-called spray-and-wipe type of application.

Because the compositions as prepared are aqueous liquid formulations and since no particular mixing is required to form the all purpose cleaning or microemulsion compositions, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient.

The instant all purpose cleaning or microemulsion composition explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

It is contemplated within the scope of the instant invention that the instant positively charged surfactant-polymer complex can be employed in hard surface cleaning compositions such as wood cleaners, window cleaners and light duty liquid cleaners.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions A to I in wt. % were prepared by simple mixing of the ingredients in water, using the following materials:

Merquat 550, ex. Nalco: Poly[acrylamide-diallyidimethyl ammonium chloride] copolymer Average MW 4.5–5.0 $10^6$. About 50/50 wt. % ratio.

Salcare Super 7, ex Ciba: Poly[acrylamide-diallyldimethyl ammonium chloride] copolymer. About 75/25 wt. % ratio.

| | A | B | C | D | E | F | G | H | I | Reference |
|---|---|---|---|---|---|---|---|---|---|---|
| Fluoroalkyl sulfonate, Na salt | 1.0 | — | 0.15 | 0.5 | 0.05 | — | 0.05 | 0.09 | 0.15 | — |
| Merquat 550 | — | 0.5 | 0.5 | 0.5 | — | 0.1 | 0.1 | 0.1 | | — |
| Salcare Super 7 | — | — | — | — | | — | — | — | 0.5 | — |
| Water | Bal. | Bal. | Bal. | Bal. | Bal. | Bal. | Bal. | Bal. | Bal. | Bal. |
| Oleophobicity[a] (Degrees) (Corn oil droplets contact angle) | 90 | 30 | 91 | 93 | 71 | 28 | 90 | 88 | — | 31 |

(a) Glass slides are dipped for 30s in 1% solutions, then left vertically for drainage and drying at room temperature. Corn oil droplets having a volume of 2–3 microliters are deposited on treated glass slides. Contact angles made by these droplets are determined using image capture equipment and analysis of droplet shapes. Contact angle images are recorded after 5s.

According to compositions B and F in Example 1, the polycationic polymer used for treating the substrate has no effect on the oil contact angle in 0.1–0.5% concentration range, as compared to the non-treated glass surface (called "reference" in Example 1). Composition G imparts a significantly stronger oleophobic character to the solid substrate, as compared to compositions F and E. Furthermore, compositions C and D lead to a reinforced oleophobic character, depending on the fluoroalkyl sulfonate content in composition. Fluoroalkyl sulfonate individual ingredient is not able to deliver similar surface oleophobic character to composition C except at a high concentration such as used in composition A. Accordingly, compositions C and G in Example 1 exhibit beneficial behavior onto treated surface regarding oleophobic properties. A stronger oil repellency effect is achieved versus fluoroalkyl sulfonate surfactant and polycationic polymer individual ingredients.

EXAMPLE 2

The following compositions in wt. % were prepared:

Merquat 550, ex. Nalco: Poly[acrylamide-diallyldimethyl ammonium chloride] copolymer Average MW 4.5–5.0 $10^6$.

CPCC 52, ex BASF: Poly[vinylpryrrolidone/vinylimidazole/quaternized vinylimidazole] [40/40/20] terpolymer.

| | A | B | C | D | Reference |
|---|---|---|---|---|---|
| Merquat 550 | 0.5 | — | — | — | — |
| Polycationic polymer CPCC52 | — | 1.0 | 1.0 | 1.0 | — |
| Fluoroalkyl sulfonate, Na salt | — | — | 0.5 | 0.9 | — |
| Water | Bal. | Bal. | Bal. | Bal. | Bal. |
| Oleophobicity[a] (Degrees) (Corn oil droplets contact angle) | 30 | 27 | 81 | 86 | 31 |

(a) Glass slides are dipped for 30s in 1% solutions, then left vertically for drainage and drying at room temperature. Corn oil droplets having a volume of 2–3 microliters are deposited on treated glass slides. Contact angles made by these droplets are determined using image capture equipment and analysis of droplet shapes. Contact angle images are recorded after 5s.

Compositions A and B in Example 2 show that individual polycationic polymers used for treating the solid substrate have no oil repellency effect, as compared to the non-treated glass surface (called "reference" in Example 2). Composition C imparts a significant oleophobic character to the glass substrate. Furthermore, composition D leads to a reinforced oleophobic character, at a higher fluoroalkyl anionic surfactant content.

EXAMPLE 3

The following compositions in wt. % were prepared:

| | A | B | C | Reference |
|---|---|---|---|---|
| Fluoroalkyl sulfonate, Na salt | 0.15 | 0.15 | — | — |
| Merquat 550 | 0.5 | — | 0.5 | — |
| Water | Bal. | Bal. | Bal. | Bal. |

-continued

| | A | B | C | Reference |
|---|---|---|---|---|
| Grease Release Performance:[a] Nbr. of Gardner strokes | 21 | >50 | 30 | 27 |
| Percentage soil removal[b] (Reflectance data) | 95 | 70 | 5 | 4 |

(a) Grease release performance pair comparison tests have been conducted using compositions A–C from Example 3. 15×15 cm formica tiles are pretreated by spreading 2 ml of composition A–C on half part of each tiles in horizontal position and allowed to rest for 90s. The other half part remains untreated and is taken as reference in the test. After 90 seconds excess solution was drained off by tipping the tiles 90 degrees. The tiles are dried overnight at room temperature. A $CHCl_3$ solution of hardened grease is sprayed on the whole surface of pre-treated sample tiles. A standard cleaner composition is used for cleaning the soiled tiles according to grease. release test procedure. The cleaning process is performed using a Gardner Washability Machine (Gardner Laboratory, Md.).

(b) The way to discriminate between different tile treatments is by determining the amount of soil removed from tiles through reflectance measurements before soiling, after soiling, and after a defined number of Gardner strokes. The soil removal percentage value given as reference in Example 3 is indicative and corresponds to the cleaning performance of standard cleaning composition on the untreated half part of sample tiles.

Composition A in Example 3 only requires 21 strokes for achieving 95% soil removal, which means a tile surface almost perfectly cleaned in visual observation. Practically no soil removal is observed on the untreated half part of sample tiles even using a higher number of Gardner strokes for cleaning (reference in Example 3). Composition A therefore allows to strongly reduce the mechanical energy required for cleaning by comparison to reference (no pre-treatment of tile surface). Synergistic cleaning benefit is provided by composition A as compositions B and C lead to significantly lower greasy soil removal percentage when cleaning with standard cleaner solution, even at higher mechanical energy, i.e., at a higher number of Gardner strokes, as shown in Example 3.

EXAMPLE 4

The following compositions in wt. % were prepared using the following materials:

Merquat 550, ex. Nalco: Poly[acrylamide-diallyldimethyl ammonium chloride] copolymer Average MW 4.5–5.0 $10^6$. About 50/50 wt. % ratio.

Salcare Super 7, ex Ciba: Poly[acrylamide-diallydimethyl ammonium chloride] copolymer. About 75/25 wt. % ratio.

| | A | B | Reference |
|---|---|---|---|
| Fluoroalkyl sulfonate, Na salt | 0.15 | 0.15 | — |
| Merquat 550 | 0.5 | — | — |
| Salcare Super 7 | — | 0.5 | — |
| Water | Bal. | Bal. | Bal. |

-continued

| | A | B | Reference |
|---|---|---|---|
| Grease Release Performance:[a] Nbr. of Gardner strokes | 17 | 30 | 17 |
| Percentage soil removal[b] (Reflectance data) | 91 | 6 | 1 |

(a) Grease release performance pair comparison tests have been conducted using compositions A and B from Example 4. Same laboratory test procedure has been used as for compositions in Example 3.

(b) The way to discriminate between different tile treatments is by determining the amount of soil removed from tiles through reflectance measurements before soiling, after soiling, and after a defined number of Gardner strokes. The soil removal percentage value given as reference in Example 4 corresponds to the cleaning performance achieved using standard cleaning composition on the untreated half part of sample tiles in the test conducted with composition A.

Composition B is much less effective when using it for pre-treating the tiles than composition A, as observed in subsequent cleaning of the pre-treated and soiled tiles. Salcare Super 7 leads to much lower soil release benefit than Merquat 550, in association with fluoroalkyl anionic surfactant.

EXAMPLE 5

The following compositions in wt. % were prepared:

| | A | B | C | Reference |
|---|---|---|---|---|
| Fluoroalkyl sulfonate, Na salt | 0.15 | 0.1 | 0.075 | — |
| Merquat 550 | 0.5 | 0.33 | 0.25 | — |
| Water | Bal. | Bal. | Bal. | Bal. |
| Grease Release Performance:[a] Nbr. of Gardner strokes | 11 | 17 | 25 | 25 |
| Percentage soil removal[b] (Reflectance data) | 95 | 89 | 84 | 3 |

(a) Grease release performance pair comparison tests have been conducted using compositions A–C from Example 5. Same laboratory test procedure has been used as for compositions in Example 3.

(b) The way to discriminate between different tile treatments is by determining the amount of soil removed from tiles through reflectance measurements before soiling, after soiling, and after a defined number of Gardner strokes. The soil removal percentage value given as reference in Example 5 is indicative and corresponds to the cleaning performance achieved using standard cleaning composition on the untreated half part of sample tiles in the test conducted with composition C.

When using composition C for pre-treating the tiles, still effective soil release benefit is observed in subsequent cleaning evaluation of the pre-treated and soiled tiles versus composition A.

What is claimed:

1. A microemulsion composition comprising approximately by weight:

(a) about 0.1 wt. % to about 20 wt. % of a positively charged complex comprising:

(i) an alkali metal salt of a fluoroalkyl sulfonate anionic surfactant or an ammonium salt of a fluoroalkyl sulfonate surfactant or mixtures thereof; and (ii) a polycationic polymer being complexed with said fluoroalkyl sulfonate anionic surfactant in a molar ratio of said anionic surfactant to the positively charged binding sites available on the backbone of said polycationic polymer about 0.95:1 to 0.05:1;

(b) 0.1 to 20% of a cosurfactant;

(c) 0.1 to 5% of a water insoluble hydrocarbon or perfume;

(d) 2 to 10% of at least one dicarboxylic acid;

(e) 0.01 to 0.2% of an aminoalkylene phosphoric acid;

(f) 0.05 to 1.0% of phosphoric acid;

(g) a magnesium sulfate heptahydrate; and (h) the balance being water.

* * * * *